US010260011B2

(12) United States Patent
Ward et al.

(10) Patent No.: US 10,260,011 B2
(45) Date of Patent: Apr. 16, 2019

(54) PROCESS AND INSTALLATION FOR THE CONVERSION OF CRUDE OIL TO PETROCHEMICALS HAVING AN IMPROVED ETHYLENE YIELD

(71) Applicants: SAUDI BASIC INDUSTRIES CORPORATION, Riyadh (SA); SABIC GLOBAL TECHNOLOGIES B.V., Bergen op Zoom (NL)

(72) Inventors: Andrew Mark Ward, Stockton-on-Tees (GB); Ravichander Narayanaswamy, Bangalore (IN); Arno Johannes Maria Oprins, Maastricht (NL); Vijayanand Rajagopalan, Bangalore (IN); Egidius Jacoba Maria Schaerlaeckens, Geleen (NL); Raul Velasco Pelaez, Maastricht (NL)

(73) Assignees: SAUDI BASIC INDUSTRIES CORPORATION, Riyadh (SA); SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 14/901,873

(22) PCT Filed: Jun. 30, 2014

(86) PCT No.: PCT/EP2014/063857
§ 371 (c)(1),
(2) Date: Dec. 29, 2015

(87) PCT Pub. No.: WO2015/000849
PCT Pub. Date: Jan. 8, 2015

(65) Prior Publication Data

US 2016/0369180 A1 Dec. 22, 2016

(30) Foreign Application Priority Data

Jul. 2, 2013 (EP) ..... 13174762

(51) Int. Cl.
*C07C 2/76* (2006.01)
*C07C 5/02* (2006.01)
(Continued)

(52) U.S. Cl.
CPC ..... *C10G 57/00* (2013.01); *C10G 9/36* (2013.01); *C10G 21/00* (2013.01); *C10G 45/00* (2013.01);
(Continued)

(58) Field of Classification Search
CPC ..... C07C 2/76; C07C 5/02; C07C 4/04
(Continued)

(56) References Cited

U.S. PATENT DOCUMENTS 3,256,176 A 6/1966 Mills et al.
3,617,501 A 11/1971 Eng et al.
(Continued)

FOREIGN PATENT DOCUMENTS

EP 2243814 A1 10/2010
JP S60-4136 1/1985
WO WO 2016/146326 9/2016

OTHER PUBLICATIONS

Wayback Bitesize (Jan. 17, 2012).*
(Continued)

*Primary Examiner* — Thuan D Dang
(74) *Attorney, Agent, or Firm* — Norton Rose Fulbright US LLP

(57) ABSTRACT

The present invention relates to an integrated process to convert crude oil into petrochemical products comprising crude oil distillation, dearomatization, ring opening, and olefins synthesis, which process comprises subjecting a hydrocarbon feed to dearomatization to produce a first stream enriched in aromatic hydrocarbons and naphthenic
(Continued)

hydrocarbons and a second stream enriched in alkanes; subjecting a stream enriched in aromatic hydrocarbons and naphthenic hydrocarbons to ring opening to produce alkanes; and subjecting refinery unit-derived alkanes produced in the process to olefins synthesis. Furthermore, the present invention relates to a process installation to convert crude oil into petrochemical products comprising a crude distillation unit comprising an inlet for crude oil and at least one outlet for one or more of naphtha, kerosene and gasoil; a dearomatization unit comprising an inlet for a hydrocarbon feed to dearomatization, an outlet for a stream enriched in aromatic hydrocarbons and naphthenic hydrocarbons and a second stream enriched in alkanes; a ring opening unit comprising an inlet for aromatics and naphthenes produced by dearomatization and an outlet for alkanes; a unit for olefins synthesis comprising an inlet for alkanes and an outlet for olefins. The hydrocarbon feed subjected to dearomatization comprises one or more of naphtha, kerosene and gasoil produced by crude oil distillation in the process; and refinery unit-derived light-distillate and/or refinery unit-derived middle-distillate produced in the process. The process and the process installation of the present invention have an increased production of petrochemicals at the expense of the production of fuels and an improved ethylene yield.

9 Claims, 3 Drawing Sheets

(51) Int. Cl.

| | |
|---|---|
| ***C07C 4/04*** | (2006.01) |
| ***C10G 57/00*** | (2006.01) |
| ***C10G 45/00*** | (2006.01) |
| ***C10G 45/58*** | (2006.01) |
| ***C10G 47/00*** | (2006.01) |
| ***C10G 67/04*** | (2006.01) |
| ***C10G 69/06*** | (2006.01) |
| ***C10G 9/36*** | (2006.01) |
| ***C10G 21/00*** | (2006.01) |

(52) U.S. Cl.
CPC ..... *C10G 45/58* (2013.01); *C10G 47/00* (2013.01); *C10G 67/0445* (2013.01); *C10G 69/06* (2013.01); *C10G 2300/1037* (2013.01); *C10G 2300/1048* (2013.01); *C10G 2400/22* (2013.01)

(58) Field of Classification Search
USPC ..... 585/324, 648, 652, 752
See application file for complete search history.

(56) References Cited

U.S. PATENT DOCUMENTS

| | | | | |
|---|---|---|---|---|
| 3,702,292 | A | 11/1972 | Burich | |
| 3,842,138 | A | 10/1974 | Chahvekilian et al. | |
| 3,891,539 | A | 6/1975 | Nelson et al. | |
| 4,137,147 | A | 1/1979 | Franck et al. | |
| 4,713,221 | A | 12/1987 | Montgomery et al. | |
| 4,789,457 | A | 12/1988 | Ficher et al. | |
| 5,436,383 | A * | 7/1995 | Le Peltier | C07C 5/325 585/655 |
| 6,153,087 | A | 11/2000 | Bigeard et al. | |
| 6,270,654 | B1 | 8/2001 | Colyar et al. | |
| 6,743,961 | B2 | 6/2004 | Powers | |
| 7,067,448 | B1 | 6/2006 | Weitkamp et al. | |
| 7,214,308 | B2 | 5/2007 | Colyar | |
| 7,513,988 | B2 | 4/2009 | Oballa et al. | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2003/0221990 | A1 | 12/2003 | Yoon et al. | |
| 2005/0101814 | A1* | 5/2005 | Foley | C10G 45/62 585/317 |
| 2008/0093262 | A1 | 4/2008 | Gragnani et al. | |
| 2013/0008660 | A1 | 1/2013 | De Rouffignac et al. | |
| 2014/0299515 | A1 | 10/2014 | Weiss et al. | |
| 2016/0122666 | A1 | 5/2016 | Weiss et al. | |

OTHER PUBLICATIONS

The UOP Uniflex Process; Robert Haizmann; UOP LLC (Apr. 2011).*

Alfke et al. (2007) Oil Refining, Ullmann's Encyclopedia of Industrial Chemistry.

International Search Report for International Application No. PCT/EP2014/063857; International Filing Date: Jun. 30, 2014; dated Oct. 13, 2014; 5 Pages.

International Union of Pure and Applied Chemistry, "Compendium of Chemical Terminology," Version 2.3.3 (Feb. 23, 2014) 1670 Pages.

Speight (2005) Petroleum Refinery Process, Kirk-Othmer Encyclopedia of Chemical Technology.

Written Opinion of the International Searching Authority for International Application No. PCT/EP2014/063857; International Filing Date: Jun. 30, 2014; dated Oct. 13, 2014; 6 Pages.

Office Action issued in Japanese Patent Application No. 2016-522567, dated Jul. 3, 2018.

Office Action issued in corresponding Indian Patent Application No. 10361/DELNP/2015, dated Feb. 6, 2019.

* cited by examiner

PROCESS AND INSTALLATION FOR THE CONVERSION OF CRUDE OIL TO PETROCHEMICALS HAVING AN IMPROVED ETHYLENE YIELD

FIELD OF THE INVENTION

The present invention relates to an integrated process to convert crude oil into petrochemical products comprising crude oil distillation, dearomatization, ring opening, and olefins synthesis. Furthermore, the present invention relates to a process installation to convert crude oil into petrochemical products comprising a crude oil distillation unit, a dearomatization unit, a ring opening unit, and a unit for olefins synthesis.

BACKGROUND OF THE INVENTION

It has been previously described that a crude oil refinery can be integrated with downstream chemical plants such as a pyrolysis steam cracking unit in order to increase the production of high-value chemicals at the expense of the production of fuels.

U.S. Pat. No. 3,702,292 describes an integrated crude oil refinery arrangement for producing fuel and chemical products, involving crude oil distillation means, hydrocracking means, delayed coking means, reforming means, ethylene and propylene producing means comprising a pyrolysis steam cracking unit and a pyrolysis products separation unit, catalytic cracking means, aromatic product recovery means, butadiene recovery means and alkylation means in an interrelated system to produce a conversion of crude oil to petrochemicals of about 50% and a conversion of crude oil to fuels of about 50%.

A major drawback of conventional means and methods to integrate oil refinery operations with downstream chemical plants to produce petrochemicals is that such integrated processes still produce significant amounts of fuel. Furthermore, conventional means and methods to integrate oil refinery operations with downstream chemical plants have a relatively low ethylene yield.

OBJECTS AND SUMMARY OF THE INVENTION

It was an object of the present invention to provide a means and methods to integrate oil refinery operations with downstream chemical plants which has an increased production of petrochemicals at the expense of the production of fuels. It was furthermore an object of the present invention to provide a means and methods to integrate oil refinery operations with downstream chemical plants which has an improved ethylene yield.

The solution to the above problem is achieved by providing the embodiments as described herein below and as characterized in the claims.

In one aspect, the present invention relates to an integrated process to convert crude oil into petrochemical products. This process is also presented in FIGS. 1-5 which are further described herein below.

Accordingly, the present invention provides an integrated process to convert crude oil into petrochemical products comprising crude oil distillation, dearomatization, ring opening, and olefins synthesis, which process comprises:

(a) subjecting a hydrocarbon feed to dearomatization to produce a first stream enriched in aromatic hydrocarbons and naphthenic hydrocarbons and a second stream enriched in alkanes;

(b) subjecting a stream enriched in aromatic hydrocarbons and naphthenic hydrocarbons to ring opening to produce alkanes; and (c) subjecting alkanes produced in the process to olefins synthesis, wherein said hydrocarbon feed comprises:

one or more of naphtha, kerosene and gasoil produced by crude oil distillation in the process; and refinery unit-derived light-distillate and/or refinery unit-derived middle-distillate produced in the process.

DETAILED DESCRIPTION

Figure 1:
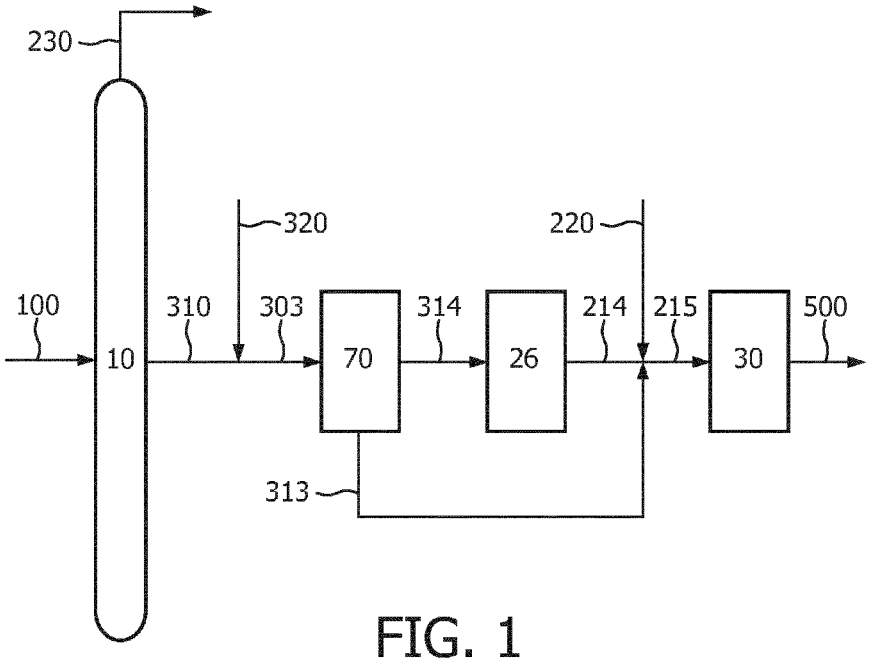
FIG. 1 shows an embodiment of a process installation according to the present invention.

Conventionally, petrochemical products, such as C2 and C3 olefins, are produced by subjecting crude oil to crude oil distillation and to subject specific crude oil fractions thus obtained to a refinery process. In the context of the present invention, it was found that the ethylene yield of a process to convert crude oil into petrochemical products can be improved by selectively subjecting the aromatics and naphthenes to ring opening and subjecting the alkanes produced in the process, including both the normal paraffins and the iso-paraffins, to olefins synthesis, when compared to subjecting the same crude oil fractions directly to steam cracking. As used herein, the term "ethylene yield" relates to the wt-% of ethylene produced of the total mass of the crude.

The prior art describes processes useful for the separation of n-paraffins from isoparaffins, naphthenes and aromatics. US 2005/0101814 A1, for instance, describes a process for cracking a naphtha feedstream to light olefins comprising converting aromatics and naphthenes to paraffins and separating iso- and normal paraffins using a ring opening reactor and an adsorption separation unit. In the process according to US 2005/0101814 A1, the non-normal paraffins including the iso-paraffins pass out of the adsorption unit as a raffinate stream that is subsequently subjected to the ring opening reaction. US 2005/0101814 A1 does not describe a process comprising a dearomatization step wherein a hydrocarbon feed is separated in a first stream enriched in aromatic hydrocarbons and naphthenic hydrocarbons and a second stream enriched in alkanes, wherein said alkanes consist of both of normal paraffins and iso-paraffins as in the process of the present invention.

Accordingly, the present invention provides an integrated process to convert crude oil into petrochemical products comprising crude oil distillation, dearomatization, ring opening, and olefins synthesis, which process comprises:

(a) subjecting a hydrocarbon feed to dearomatization to produce a first stream enriched in aromatic hydrocarbons and naphthenic hydrocarbons and a second stream enriched in alkanes;

(b) subjecting a stream enriched in aromatic hydrocarbons and naphthenic hydrocarbons to ring opening to produce alkanes; and (c) subjecting alkanes produced in the process to olefins synthesis, wherein said hydrocarbon feed comprises:

one or more of naphtha, kerosene and gasoil produced by crude oil distillation in the process; and refinery unit-derived light-distillate and/or refinery unit-derived middle-distillate produced in the process;

wherein said alkanes consist of normal-paraffins and iso-paraffins.

Accordingly, the term "one or more of naphtha, kerosene and gasoil produced by crude oil distillation in the process" means that said one or more of naphtha, kerosene and gasoil are produced by the crude distillation process step comprised in the integrated process of the present invention. Moreover, the term "refinery unit-derived light-distillate and/or refinery unit-derived middle-distillate produced in the process" means that said refinery unit-derived light-distillate and/or refinery unit-derived middle-distillate are produced by a refinery unit process step comprised in the integrated process of the present invention.

In the present invention, accordingly, the hydrocarbon feed subjected to dearomatization comprises:

one or more of naphtha, kerosene and gasoil produced by crude oil distillation in the process; and refinery unit-derived light-distillate and/or refinery unit-derived middle-distillate produced in the process.

Preferably, the hydrocarbon feed subjected to dearomatization in the present invention comprises:

two or more of naphtha, kerosene and gasoil produced by crude oil distillation in the process; and refinery unit-derived light-distillate and/or refinery unit-derived middle-distillate produced in the process.

More preferably, the hydrocarbon feed subjected to dearomatization in the present invention comprises:

naphtha, kerosene and gasoil produced by crude oil distillation in the process; and refinery unit-derived light-distillate and/or refinery unit-derived middle-distillate produced in the process.

Particularly preferably, the hydrocarbon feed subjected to dearomatization in the present invention comprises:

one or more of naphtha, kerosene and gasoil produced by crude oil distillation in the process; and refinery unit-derived light-distillate and refinery unit-derived middle-distillate produced in the process.

More particularly preferably, the hydrocarbon feed subjected to dearomatization in the present invention comprises:

two or more of naphtha, kerosene and gasoil produced by crude oil distillation in the process; and refinery unit-derived light-distillate and refinery unit-derived middle-distillate produced in the process.

Most preferably, the hydrocarbon feed subjected to dearomatization in the present invention comprises:

naphtha, kerosene and gasoil produced by crude oil distillation in the process; and refinery unit-derived light-distillate and refinery unit-derived middle-distillate produced in the process.

The term "crude oil" as used herein refers to the petroleum extracted from geologic formations in its unrefined form. The term crude oil will also be understood to include that which has been subjected to water-oil separations and/or gas-oil separation and/or desalting and/or stabilization. Any crude oil is suitable as the source material for the process of this invention, including Arabian Heavy, Arabian Light, other Gulf crudes, Brent, North Sea crudes, North and West African crudes, Indonesian, Chinese crudes and mixtures thereof, but also shale oil, tar sands, gas condensates and bio-based oils. The crude oil used as feed to the process of the present invention preferably is conventional petroleum having an API gravity of more than 20° API as measured by the ASTM D287 standard. More preferably, the crude oil used in the process of the present invention is a light crude oil having an API gravity of more than 30° API. Most preferably, the crude oil used in the process of the present invention comprises Arabian Light Crude Oil. Arabian Light Crude Oil typically has an API gravity of between 32-36° API and a sulfur content of between 1.5-4.5 wt-%.

The term "petrochemicals" or "petrochemical products" as used herein relates to chemical products derived from crude oil that are not used as fuels. Petrochemical products include olefins and aromatics that are used as a basic feedstock for producing chemicals and polymers. High-value petrochemicals include olefins and aromatics. Typical high-value olefins include, but are not limited to, ethylene, propylene, butadiene, butylene-1, isobutylene, isoprene, cyclopentadiene and styrene. Typical high-value aromatics include, but are not limited to, benzene, toluene, xylene and ethyl benzene.

The term "fuels" as used herein relates to crude oil-derived products used as energy carrier. Unlike petrochemicals, which are a collection of well-defined compounds, fuels typically are complex mixtures of different hydrocarbon compounds. Fuels commonly produced by oil refineries include, but are not limited to, gasoline, jet fuel, diesel fuel, heavy fuel oil and petroleum coke.

The term "gases produced by the crude distillation unit" or "gases fraction" as used herein refers to the fraction obtained in a crude oil distillation process that is gaseous at ambient temperatures. Accordingly, the "gases fraction" derived by crude distillation mainly comprises C1-C4 hydrocarbons and may further comprise impurities such as hydrogen sulfide and carbon dioxide. In this specification, other petroleum fractions obtained by crude oil distillation are referred to as "naphtha", "kerosene", "gasoil" and "resid". The terms naphtha, kerosene, gasoil and resid are used herein having their generally accepted meaning in the field of petroleum refinery processes; see Alfke et al. (2007) Oil Refining, Ullmann's Encyclopedia of Industrial Chemistry and Speight (2005) Petroleum Refinery Processes, Kirk-Othmer Encyclopedia of Chemical Technology. In this respect, it is to be noted that there may be overlap between the different crude oil distillation fractions due to the complex mixture of the hydrocarbon compounds comprised in the crude oil and the technical limits to the crude oil distillation process. Preferably, the term "naphtha" as used herein relates to the petroleum fraction obtained by crude oil distillation having a boiling point range of about 20-200° C., more preferably of about 30-190° C. Preferably, light naphtha is the fraction having a boiling point range of about 20-100° C., more preferably of about 30-90° C. Heavy naphtha preferably has a boiling point range of about 80-200° C., more preferably of about 90-190° C. Preferably, the term "kerosene" as used herein relates to the petroleum fraction obtained by crude oil distillation having a boiling point range of about 180-270° C., more preferably of about 190-260° C. Preferably, the term "gasoil" as used herein relates to the petroleum fraction obtained by crude oil distillation having a boiling point range of about 250-360° C., more preferably of about 260-350° C. Preferably, the term "resid" as used herein relates to the petroleum fraction obtained by crude oil distillation having a boiling point of more than about 340° C., more preferably of more than about 350° C.

As used herein, the term "refinery unit" relates to a section of a petrochemical plant complex for the chemical conversion of crude oil to petrochemicals and fuels. In this respect, it is to be noted that a unit for olefins synthesis, such as a steam cracker, is also considered to represent a "refinery unit". In this specification, different hydrocarbons streams produced by refinery units or produced in refinery unit operations are referred to as: refinery unit-derived gases, refinery unit-derived light-distillate, refinery unit-derived middle-distillate and refinery unit-derived heavy-distillate. Accordingly, a refinery unit derived distillate is obtained as the result of a chemical conversion followed by a separation, e.g. by distillation or by extraction, which is in contrast to a crude oil fraction. The term "refinery unit-derived gases" relates to the fraction of the products produced in a refinery unit that is gaseous at ambient temperatures. Accordingly, the refinery unit-derived gas stream may comprise gaseous compounds such LPG and methane. Other components comprised in the refinery unit-derived gas stream may be hydrogen and hydrogen sulfide. The terms light-distillate, middle-distillate and heavy-distillate are used herein having their generally accepted meaning in the field of petroleum refinery processes; see Speight, J. G. (2005) loc.cit. In this respect, it is to be noted that there may be overlap between different distillation fractions due to the complex mixture of the hydrocarbon compounds comprised in the product stream produced by refinery unit operations and the technical limits to the distillation process used to separate the different fractions. Preferably, the refinery-unit derived light-distillate is the hydrocarbon distillate obtained in a refinery unit process having a boiling point range of about 20-200° C., more preferably of about 30-190° C. The "light-distillate" is often relatively rich in aromatic hydrocarbons having one aromatic ring. Preferably, the refinery-unit derived middle-distillate is the hydrocarbon distillate obtained in a refinery unit process having a boiling point range of about 180-360° C., more preferably of about 190-350° C. The "middle-distillate" is relatively rich in aromatic hydrocarbons having two aromatic rings. Preferably, the refinery-unit derived heavy-distillate is the hydrocarbon distillate obtained in a refinery unit process having a boiling point of more than about 340° C., more preferably of more than about 350° C. The "heavy-distillate" is relatively rich in hydrocarbons having condensed aromatic rings.

The term "alkane" or "alkanes" is used herein having its established meaning and accordingly describes acyclic branched or unbranched hydrocarbons having the general formula $C_nH_{2n+2}$, and therefore consisting entirely of hydrogen atoms and saturated carbon atoms; see e.g. IUPAC. Compendium of Chemical Terminology, 2nd ed. (1997). The term "alkanes" accordingly describes unbranched alkanes ("normal-paraffins" or "n-paraffins" or "n-alkanes") and branched alkanes ("iso-paraffins" or "iso-alkanes") but excludes naphthenes (cycloalkanes).

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekulé structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly describes saturated cyclic hydrocarbons.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C2 and C3 hydrocarbons (i.e. a mixture of C2 and C3 hydrocarbons.

One of the petrochemical products produced in the process of the present invention is BTX. The term "BTX" as used herein relates to a mixture of benzene, toluene and xylenes. Preferably, the product produced in the process of the present invention comprises further useful aromatic hydrocarbons such as ethylbenzene. Accordingly, the present invention preferably provides a process for producing a mixture of benzene, toluene xylenes and ethylbenzene ("BTXE"). The product as produced may be a physical mixture of the different aromatic hydrocarbons or may be directly subjected to further separation, e.g. by distillation, to provide different purified product streams. Such purified product stream may include a benzene product stream, a toluene product stream, a xylene product stream and/or an ethylbenzene product stream.

As used herein, the term "C# hydrocarbons", wherein "#" is a positive integer, is meant to describe all hydrocarbons having # carbon atoms. Moreover, the term "C#+ hydrocarbons" is meant to describe all hydrocarbon molecules having # or more carbon atoms. Accordingly, the term "C5+ hydrocarbons" is meant to describe a mixture of hydrocarbons having 5 or more carbon atoms. The term "C5+ alkanes" accordingly relates to alkanes having 5 or more carbon atoms.

The process of the present invention involves crude distillation, which comprises separating different crude oil fractions based on a difference in boiling point. As used herein, the term "crude distillation unit" or "crude oil distillation unit" relates to the fractionating column that is used to separate crude oil into fractions by fractional distillation; see Alfke et al. (2007) loc.cit. Preferably, the crude oil is processed in an atmospheric distillation unit to separate gas oil and lighter fractions from higher boiling components (atmospheric residuum or "resid"). In the present invention, it is not required to pass the resid to a vacuum distillation unit for further fractionation of the resid, and it is possible to process the resid as a single fraction. In case of relatively heavy crude oil feeds, however, it may be advantageous to further fractionate the resid using a vacuum distillation unit to further separate the resid into a vacuum gas oil fraction and vacuum residue fraction. In case vacuum distillation is used, the vacuum gas oil fraction and vacuum residue fraction may be processed separately in the subsequent refinery units. For instance, the vacuum residue fraction may be specifically subjected to solvent deasphalting before further processing. Preferably, the term "vacuum gas oil" as used herein relates to the petroleum fraction obtained by crude oil distillation having a having a boiling point range of about 340-560° C., more preferably of about 350-550° C. Preferably, the term "vacuum resid" as used herein relates to the petroleum fraction obtained by crude oil distillation having a boiling point of more than about 540° C., more preferably of more than about 550° C.

As used herein, the term "dearomatization unit" relates to a refinery unit for the separation of aromatic hydrocarbons, such as BTX, and naphthenes from a mixed hydrocarbon feed. One preferred process to separate a mixed hydrocarbon stream into a stream comprising predominantly paraffins and a second stream comprising predominantly aromatics and preferably naphthenes comprises processing said mixed hydrocarbon stream in a solvent extraction unit comprising three main hydrocarbon processing columns: solvent extraction column, stripper column and extract column. Conventional solvents selective for the extraction of aromatics are also selective for dissolving light naphthenic and to a lesser extent light paraffinic species hence the stream exiting the base of the solvent extraction column comprises solvent together with dissolved aromatic, naphthenic and light paraffinic species. The stream exiting the top of the solvent extraction column (often termed the raffinate stream) comprises the relatively insoluble, with respect to the chosen solvent) paraffinic species. The stream exiting the base of the solvent extraction column is then subjected, in a distillation column, to evaporative stripping in which species are separated on the basis of their relative volatility in the presence of the solvent. In the presence of a solvent, light paraffinic species have higher relative volatilities than naphthenic species and especially aromatic species with the same number of carbon atoms, hence the majority of light paraffinic species may be concentrated in the overhead stream from the evaporative stripping column. This stream may be combined with the raffinate stream from the solvent extraction column or collected as a separate light hydrocarbon stream. Due to their relatively low volatility the majority of the naphthenic and especially aromatic species are retained in the combined solvent and dissolved hydrocarbon stream exiting the base of this column. In the final hydrocarbon processing column of the extraction unit, the solvent is separated from the dissolved hydrocarbon species by distillation. In this step the solvent, which has a relatively high boiling point, is recovered as the base stream from the column whilst the dissolved hydrocarbons, comprising mainly aromatics and naphthenic species, are recovered as the vapour stream exiting the top of the column. This latter stream is often termed the extract. The solvents that may be used in aromatic solvent extraction process of the present invention include those solvents that are commonly used in commercial aromatics extraction processes such as sulfolane, tetraethylene glycol and N-methylpyrolidone. These species may be used in combination with other solvents or other chemicals (sometimes called co-solvents) such as water and/or alcohols. Alternatively, other known methods than solvent extraction, such as molecular sieve separation or separation based on boiling point, can be applied for the separation of aromatics and naphthenes from paraffins in a dearomatization process. Accordingly, the dearomatization process step provides a stream comprising predominantly paraffins ("alkanes enriched stream produced by dearomatization") and a second stream comprising predominantly aromatics and preferably naphthenes ("aromatics and naphthenes enriched stream produced by dearomatization"). Preferably, the alkanes enriched stream produced by dearomatization comprises more than 80 wt-% of the alkanes and less than 60 wt-% of the naphthenes that were comprised in the mixed hydrocarbon stream, more preferably more than 85 wt-% of the alkanes and less than 55 wt-% of the naphthenes that were comprised in the mixed hydrocarbon stream. Preferably, the aromatics and naphthenes enriched stream produced by dearomatization comprises more than 90 wt-% of the aromatics and more than 40 wt-% of the naphthenes that were comprised in the mixed hydrocarbon stream, more preferably more than 95 wt-% of the aromatics and more than 45 wt-% of the naphthenes that were comprised in the mixed hydrocarbon stream.

The "ring opening unit" refers to a refinery unit wherein the aromatic and naphthenic ring opening process is performed. Ring opening is a specific hydrocracking process that is particularly suitable for converting a feed that is relatively rich in aromatic hydrocarbons and naphthenic hydrocarbons having a boiling point in the kerosene and gasoil boiling point range, and optionally the vacuum gasoil boiling point range, to produce LPG and, depending on the specific process and/or process conditions, a light-distillate. Such a ring opening process (RO process) is for instance described in U.S. Pat. No. 3,256,176 and U.S. Pat. No. 4,789,457. Such processes may comprise of either a single fixed bed catalytic reactor or two such reactors in series together with one or more fractionation units to separate desired products from unconverted material and may also incorporate the ability to recycle unconverted material to one or both of the reactors. Reactors may be operated at a temperature of 200-600° C., preferably 300-400° C., a pressure of 3-35 MPa, preferably 5 to 20 MPa together with 5-20 wt-% of hydrogen (in relation to the hydrocarbon feedstock), wherein said hydrogen may flow co-current with the hydrocarbon feedstock or counter current to the direction of flow of the hydrocarbon feedstock, in the presence of a dual functional catalyst active for both hydrogenation-dehydrogenation and ring cleavage, wherein said aromatic ring saturation and ring cleavage may be performed. Catalysts used in such processes comprise one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. In this respect, it is to be noted that the term "supported on" as used herein includes any conventional way to provide a catalyst which combines one or more elements with a catalytic support. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the ARO process produces a light-distillate ("RO-gasoline") which is relatively rich in hydrocarbon compounds having one aromatic and or naphthenic ring. In the context of the present invention, it is preferred to use an aromatic ring opening process that is optimized to keep one aromatic or naphthenic ring intact and thus to produce a light-distillate which is relatively rich in hydrocarbon compounds having one aromatic or naphthenic ring. A further ring opening process (RO process) is described in U.S. Pat. No. 7,513,988. Accordingly, the RO process may comprise aromatic ring saturation at a temperature of 100-500° C., preferably 200-500° C., more preferably 300-500° C., a pressure of 2-10 MPa together with 5-30 wt-%, preferably 10-30 wt-% of hydrogen (in relation to the hydrocarbon feedstock) in the presence of an aromatic hydrogenation catalyst and ring cleavage at a temperature of 200-600° C., preferably 300-400° C., a pressure of 1-12 MPa together with 5-20 wt-% of hydrogen (in relation to the hydrocarbon feedstock) in the presence of a ring cleavage catalyst, wherein said aromatic ring saturation and ring cleavage may be performed in one reactor or in two consecutive reactors. The aromatic hydrogenation catalyst may be a conventional hydrogenation/hydrotreating catalyst such as a catalyst comprising a mixture of Ni, W and Mo on a refractory support, typically alumina. The ring cleavage catalyst comprises a transition metal or metal sulphide component and a support. Preferably the catalyst comprises one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the RO process produces a light-distillate ("RO-gasoline") which is relatively rich in hydrocarbon compounds having one aromatic ring. In the context of the present invention, it is preferred to use a ring opening process that is optimized to open all aromatic rings and naphthenic rings and thus to produce alkanes at the expense of a light-distillate which is relatively rich in hydrocarbon compounds having one aromatic ring. Yet, also in a mode wherein all aromatic rings are opened, the RO process may still produce small amounts of distillates, which are preferably recycled to refinery units capable of processing and upgrading said distillates to petrochemicals or to intermediate products that can be further upgraded to petrochemicals. Other examples of ring opening processes to produce LPG are described in U.S. Pat. No. 7,067,448 and US 2005/0101814.

The hydrocarbon feed used in the process of the present invention preferably comprises naphtha, kerosene and gasoil produced by crude oil distillation in the process and refinery unit-derived light-distillate and refinery unit-derived middle-distillate produced in the process.

The LPG produced in the process that is subjected to olefins synthesis preferably comprises LPG comprised in the gases fraction derived by crude distillation and LPG comprised in the refinery unit-derived gases.

Preferably, the process of the present invention further comprises subjecting refinery unit-derived alkanes produced in the process to reverse isomerization to produce n-alkanes which are subjected to olefins synthesis.

By converting the iso-alkanes to normal-alkanes before subjecting said alkanes to olefins synthesis, the ethylene yield in said olefins synthesis can be improved.

Preferably, the C4-C8 alkanes are subjected to reverse isomerization to convert the iso- (branched) C4-C8 alkanes to normal- (unbranched) C4-C8 alkanes, which are subsequently subjected to olefins synthesis.

As used herein, the term "reverse isomerization unit" relates to a refinery unit that is operated to convert isoalkanes, such as the isobutane and the isoalkanes comprised in a naphtha and/or a refinery unit-derived light-distillate, to normal-alkanes. Such a reverse isomerization process is closely related to the more conventional isomerization process to increase the octane rating of gasoline fuels and is inter alia described EP 2 243 814 A1. The feedstream to a reverse isomerization unit preferably is relatively rich in paraffins, preferably isoparaffins, e.g. by removing the aromatics and naphthenes by dearomatization and/or by converting the aromatics and naphthenes to paraffins using a ring opening process. The effect of treating highly paraffinic naphtha in a reverse isomerization unit is that by the conversion of isoparaffins to normal paraffins, the yield of ethylene in a steam cracking process is increased while reducing the yields of methane, C4 hydrocarbons and pyrolysis gasoline. The process conditions for reverse isomerization preferably include a temperature of 50-350° C., preferably of 150-250° C., a pressure of 0.1-10 MPa gauge, preferably of 0.5-4 MPa gauge and a liquid hour space velocity of 0.2-15 volumes of reverse-isomerizable hydrocarbon feed per hour per volume of catalyst, preferably of 0.5-5 $hr^{-1}$. Any catalyst known in the art to be suitable for the isomerization of paraffin-rich hydrocarbon streams may be used as a reverse-isomerization catalyst. Preferably, the reverse isomerization catalyst comprises a Group 10 element supported on a zeolite and/or a refractory support, such as alumina.

Preferably, the ring opening process as used herein produces a first stream comprising LPG and a second stream comprising C4+ alkanes and wherein said stream comprising C4+ alkanes is combined with alkanes produced by dearomatization.

By separating the LPG produced in the process of the present invention from the C4+ alkanes, said LPG and said C4+ alkanes can be subjected to specific olefins synthesis processes which are optimized towards the nature of the hydrocarbon feed.

Preferably at least 50 wt-%, more preferably at least 60 wt-%, even more preferably at least 70 wt-%, particularly preferably at least 80 wt-%, more particularly preferably at least 90 wt-% and most preferably at least 95 wt-% of the combined naphtha, kerosene and gasoil produced by the crude oil distillation in the process is subjected to hydrocracking. Accordingly, preferably less than 50 wt-%, more preferably less than 40 wt-%, even more preferably less than 30 wt-%, particularly preferably less than 20 wt-%, more particularly preferably less than 10 wt-% and most preferably less 5 wt-% of the crude oil is converted into fuels in the process of the present invention.

As used herein, the term "unit for olefins synthesis" relates to a unit wherein a process for the conversion of alkanes to olefins is performed. This term includes any process for the conversion of hydrocarbons to olefins including, but not limited to non-catalytic processes such as pyrolysis or steam cracking, catalytic processes such as propane dehydrogenation or butane dehydrogenation, and combinations of the two such as catalytic steam cracking.

Preferably, olefins synthesis used in the process of the present invention is pyrolysis. By selecting pyrolysis as the olefins synthesis method, the yield of ethylene is improved.

A very common process for the conversion of alkanes to olefins involves "steam cracking" or "pyrolysis". As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is 750-900° C., but the reaction is only allowed to take place very briefly, usually with residence times of 50-1000 milliseconds. Preferably, a relatively low process pressure is to be selected of atmospheric up to 175 kPa gauge. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butane or light naphtha give product streams rich in the lighter polymer grade olefins, including ethylene, propylene, and butadiene. Heavier hydrocarbon (full range and heavy naphtha and gas oil fractions) also give products rich in aromatic hydrocarbons.

To separate the different hydrocarbon compounds produced by steam cracking the cracked gas is subjected to a fractionation unit. Such fractionation units are well known in the art and may comprise a so-called gasoline fractionator where the heavy-distillate ("carbon black oil") and the middle-distillate ("cracked distillate") are separated from the light-distillate and the gases. In the subsequent optional quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light distillate may be separated from the gases between the compression stages. Also acid gases ($CO_2$ and $H_2S$) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the process for olefins synthesis.

Preferably, LPG produced in the integrated process is subjected to gas cracking and wherein C4+ alkanes are subjected to liquid cracking. Preferably, C2 and C3 alkanes are cracked separately at their optimal conditions. Preferably, C4 and C5+ are cracked separately at their optimal conditions. Preferably, the cracked distillate and carbon black oil produced in the process of the present invention are recycled to the hydrocarbon feed that is subjected to dearomatization.

Preferably, the process of the present invention further comprises:

(a) subjecting crude oil to crude oil distillation to produce one or more of gases fraction, naphtha, kerosene, gasoil and resid; and (b) subjecting resid to resid upgrading to produce LPG and light- and middle-distillate.

By specifically subjecting resid to resid upgrading to produce LPG and a liquid resid upgrading effluent and by subjecting said liquid resid upgrading effluent to ring opening, the ethylene yield or the process of the present invention can be further improved. Furthermore, the crude oil can be upgraded to petrochemical products, particularly ethylene, to a much greater extent.

As used herein, the term "resid upgrading unit" relates to a refinery unit suitable for the process of resid upgrading, which is a process for breaking the hydrocarbons comprised in the resid and/or refinery unit-derived heavy-distillate into lower boiling point hydrocarbons; see Alfke et al. (2007) loc.cit. Commercially available technologies include a delayed coker, a fluid coker, a resid FCC, a Flexicoker, a visbreaker or a catalytic hydrovisbreaker. Preferably, the resid upgrading unit may be a coking unit or a resid hydrocracker. A "coking unit" is an oil refinery processing unit that converts resid into LPG, light-distillate, middle-distillate, heavy-distillate and petroleum coke. The process thermally cracks the long chain hydrocarbon molecules in the residual oil feed into shorter chain molecules.

The feed to resid upgrading preferably comprises resid and heavy-distillate produced in the process. Such heavy-distillate may comprise the heavy-distillate produced by a steam cracker, such as carbon black oil and/or cracked distillate but may also comprise the heavy distillate produced by resid upgrading, which may be recycled to extinction. Yet, a relatively small pitch stream may be purged from the process.

The resid upgrading that is preferably used in the process of the present invention is resid hydrocracking.

By selecting resid hydrocracking over other means for resid upgrading, the ethylene yield and the carbon efficiency of the process of the present invention can be further improved.

A "resid hydrocracker" is an oil refinery processing unit that is suitable for the process of resid hydrocracking, which is a process to convert resid into LPG, light distillate, middle-distillate and heavy-distillate. Resid hydrocracking processes are well known in the art; see e.g. Alfke et al. (2007) loc.cit. Accordingly, 3 basic reactor types are employed in commercial hydrocracking which are a fixed bed (trickle bed) reactor type, an ebullated bed reactor type and slurry (entrained flow) reactor type. Fixed bed resid hydrocracking processes are well-established and are capable of processing contaminated streams such as atmospheric residues and vacuum residues to produce light- and middle-distillate which can be further processed to produce olefins and aromatics. The catalysts used in fixed bed resid hydrocracking processes commonly comprise one or more elements selected from the group consisting of Co, Mo and Ni on a refractory support, typically alumina. In case of highly contaminated feeds, the catalyst in fixed bed resid hydrocracking processes may also be replenished to a certain extend (moving bed). The process conditions commonly comprise a temperature of 350-450° C. and a pressure of 2-20 MPa gauge. Ebullated bed resid hydrocracking processes are also well-established and are inter alia characterized in that the catalyst is continuously replaced allowing the processing of highly contaminated feeds. The catalysts used in ebullated bed resid hydrocracking processes commonly comprise one or more elements selected from the group consisting of Co, Mo and Ni on a refractory support, typically alumina. The small particle size of the catalysts employed effectively increases their activity (c.f. similar formulations in forms suitable for fixed bed applications). These two factors allow ebullated bed hydrocracking processes to achieve significantly higher yields of light products and higher levels of hydrogen addition when compared to fixed bed hydrocracking units. The process conditions commonly comprise a temperature of 350-450° C. and a pressure of 5-25 MPa gauge. Slurry resid hydrocracking processes represent a combination of thermal cracking and catalytic hydrogenation to achieve high yields of distillable products from highly contaminated resid feeds. In the first liquid stage, thermal cracking and hydrocracking reactions occur simultaneously in the fluidized bed at process conditions that include a temperature of 400-500° C. and a pressure of 15-25 MPa gauge. Resid, hydrogen and catalyst are introduced at the bottom of the reactor and a fluidized bed is formed, the height of which depends on flow rate and desired conversion. In these processes catalyst is continuously replaced to achieve consistent conversion levels through an operating cycle. The catalyst may be an unsupported metal sulfide that is generated in situ within the reactor. In practice the additional costs associated with the ebullated bed and slurry phase reactors are only justified when a high conversion of highly contaminated heavy streams such as vacuum gas oils is required. Under these circumstances the limited conversion of very large molecules and the difficulties associated with catalyst deactivation make fixed bed processes relatively unattractive in the process of the present invention. Accordingly, ebullated bed and slurry reactor types are preferred due to their improved yield of light- and middle-distillate when compared to fixed bed hydrocracking. As used herein, the term "resid upgrading liquid effluent" relates to the product produced by resid upgrading excluding the gaseous products, such as methane and LPG and the heavy distillate produced by resid upgrading. The heavy-distillate produced by resid upgrading is preferably recycled to the resid upgrading unit until extinction. However, it may be necessary to purge a relatively small pitch stream. From the viewpoint of carbon efficiency, a resid hydrocracker is preferred over a coking unit as the latter produces considerable amounts of petroleum coke that cannot be upgraded to high value petrochemical products. From the viewpoint of the hydrogen balance of the integrated process, it may be preferred to select a coking unit over a resid hydrocracker as the latter consumes considerable amounts of hydrogen. Also in view of the capital expenditure and/or the operating costs it may be advantageous to select a coking unit over a resid hydrocracker.

In case the resid is further fractionated using a vacuum distillation unit to separate the resid into a vacuum gas oil fraction and vacuum residue fraction, it is preferred to subject the vacuum gasoil to vacuum gasoil hydrocracking and the vacuum resid to vacuum resid hydrocracking, wherein the heavy distillate produced by vacuum resid hydrocracking is subsequently subjected to vacuum gasoil hydrocracking. In case the present invention involves vacuum distillation, the vacuum gasoil thus obtained is preferably fed to the aromatic ring opening unit together with one or more other hydrocarbon streams that are relatively rich in aromatic hydrocarbons and which have a boiling point in the kerosene and gasoil boiling point range. Such hydrocarbon streams that are relatively rich in aromatic hydrocarbons and which have a boiling point in the kerosene and gasoil boiling point range may be selected from the group consisting of kerosene, gasoil and middle-distillate. The vacuum residue hydrocracking preferably is slurry resid hydrocracking as defined herein above.

The process of the present invention may require removal of sulfur from certain crude oil fractions to prevent catalyst deactivation in downstream refinery processes, such as catalytic reforming or fluid catalytic cracking. Such a hydrodesulfurization process is performed in a "HDS unit" or "hydrotreater"; see Alfke (2007) loc. cit. Generally, the hydrodesulfurization reaction takes place in a fixed-bed reactor at elevated temperatures of 200-425° C., preferably of 300-400° C. and elevated pressures of 1-20 MPa gauge, preferably 1-13 MPa gauge in the presence of a catalyst comprising elements selected from the group consisting of Ni, Mo, Co, W and Pt, with or without promoters, supported on alumina, wherein the catalyst is in a sulfide form.

In a further aspect, the invention also relates to a process installation suitable for performing the process of the invention. This process installation and the process as performed in said process installation are presented in FIGS. 1-5 (FIG. 1-5).

Accordingly, the present invention further provides a process installation to convert crude oil into petrochemical products comprising a crude distillation unit (10) comprising an inlet for crude oil (100) and at least one outlet for one or more of naphtha, kerosene and gasoil (310);

a dearomatization unit (70) comprising an inlet for a hydrocarbon feed to dearomatization (303), an outlet for a stream enriched in aromatic hydrocarbons and naphthenic hydrocarbons (314) and a second stream enriched in alkanes (313);

a ring opening unit (26) comprising an inlet for aromatics and naphthenes produced by dearomatization (314) and an outlet for alkanes (214); and a unit for olefins synthesis (30) comprising an inlet for alkanes (215) and an outlet for olefins (500), wherein said hydrocarbon feed to dearomatization comprises:

one or more of naphtha, kerosene and gasoil produced by the crude oil distillation unit (10); and refinery unit-derived light-distillate and/or refinery unit-derived middle-distillate produced the integrated petrochemical process installation.

This aspect of the present invention is presented in FIG. 1 (FIG. 1).

The crude distillation unit (10) preferably further comprises an outlet for gases fraction (230). The alkanes produced by ring opening (214), the stream enriched in alkanes (313) and LPG produced in the integrated process (220) may be combined to form the inlet for alkanes (215). Furthermore, one or more of naphtha, kerosene and gasoil produced by the crude oil distillation unit (310) may be combined with refinery unit-derived light-distillate and/or refinery unit-derived middle-distillate produced the integrated petrochemical process installation (320) to form a hydrocarbon feed to dearomatization (303).

As used herein, the term "an inlet for X" or "an outlet of X", wherein "X" is a given hydrocarbon fraction or the like relates to an inlet or outlet for a stream comprising said hydrocarbon fraction or the like. In case of an outlet for X is directly connected to a downstream refinery unit comprising an inlet for X, said direct connection may comprise further units such as heat exchangers, separation and/or purification units to remove undesired compounds comprised in said stream and the like.

If, in the context of the present invention, a refinery unit is fed with more than one feed stream, said feedstreams may be combined to form one single inlet into the refinery unit or may form separate inlets to the refinery unit.

Figure 2:
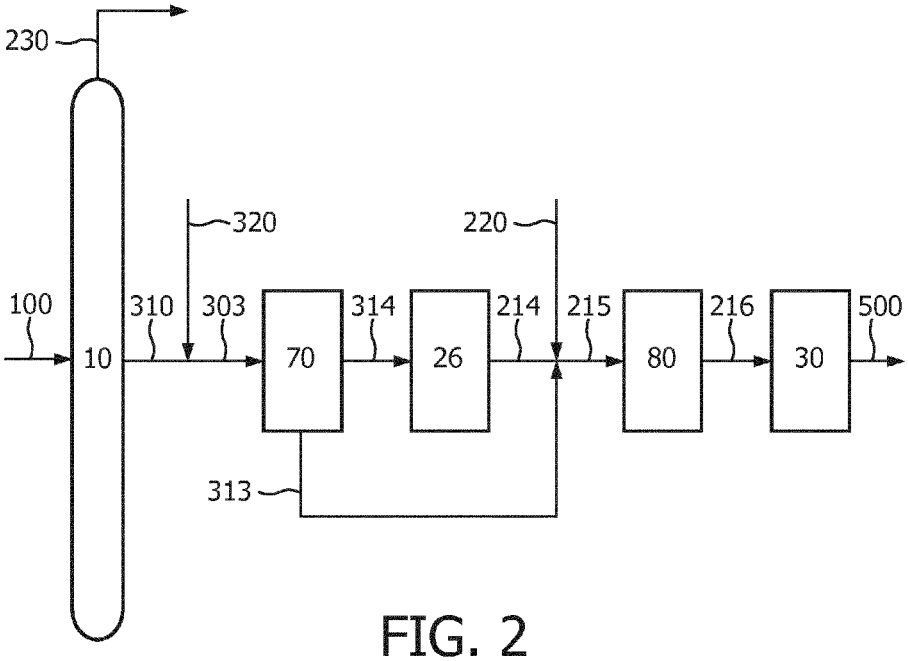
FIG. 2 shows an embodiment of a process installation according to the present invention.

The process installation of the present invention may further comprise a reverse isomerization unit (80) comprising an inlet an inlet for alkanes (215) and an outlet for n-alkanes (216), wherein said n-alkanes produced by said reverse isomerization unit (80) are fed to a unit for olefins synthesis (30). This aspect of the present invention is presented in FIG. 2 (FIG. 2).

Figure 3:
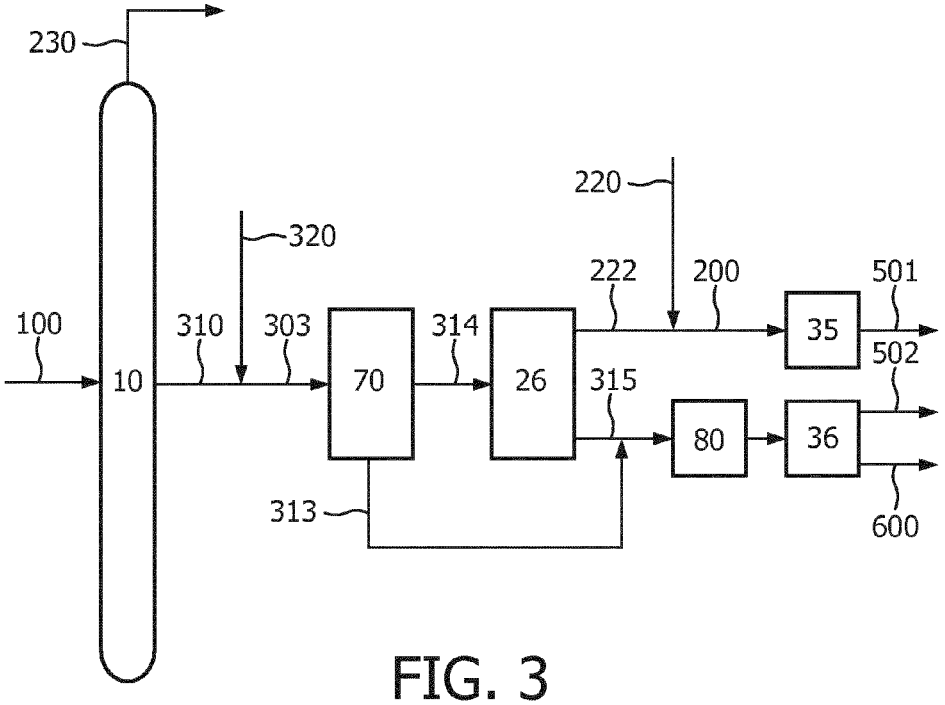
FIG. 3 shows an embodiment of a process installation according to the present invention.

The ring opening unit (26) as comprised in the process installation of the present invention may further comprise an outlet for LPG produced by ring opening (222) and an outlet for C4+ alkanes (315) that is combined with alkanes produced by dearomatization (313). This aspect of the present invention is presented in FIG. 3 (FIG. 3).

In such an embodiment, the LPG produced by ring opening (222) and LPG produced in the integrated process (220) may be combined to form the LPG produced by the integrated petrochemical process installation (200). This aspect of the present invention is presented in FIG. 3 (FIG. 3).

In case the ring opening unit (26) has an outlet for LPG produced by ring opening (222) and an outlet for C4+ alkanes (315), the process installation may further comprise a gas cracker (35) comprising an inlet for LPG produced in the integrated process (200) and an outlet for olefins (501); and a liquid cracker (36) comprising an inlet for alkanes (215), preferably n-alkanes (216), an outlet for olefins (502) and an outlet for BTX (600).

Figure 4:
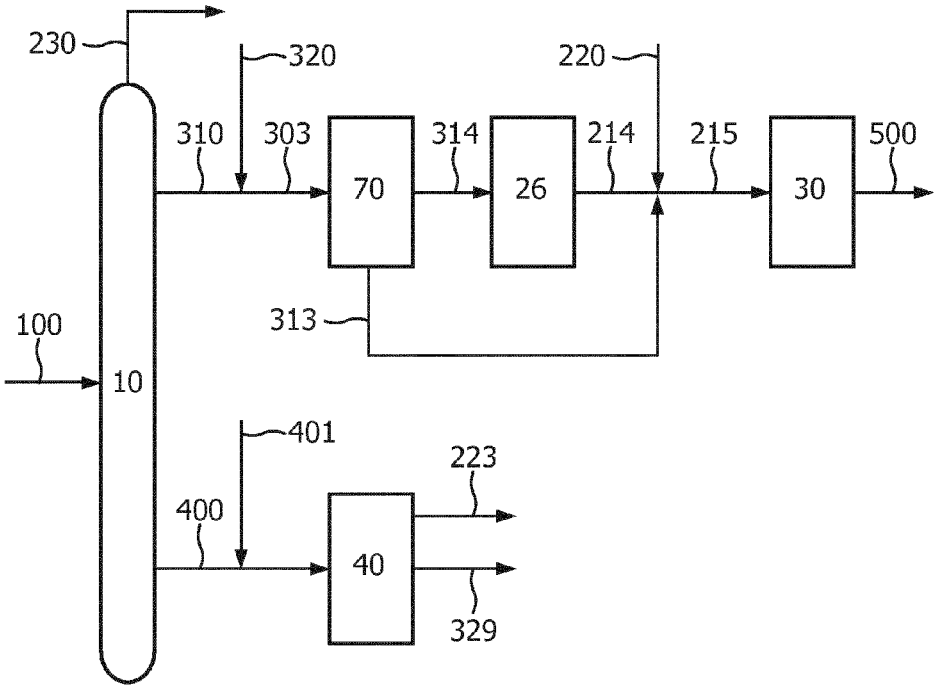
FIG. 4 shows an embodiment of a process installation according to the present invention.
Figure 5:
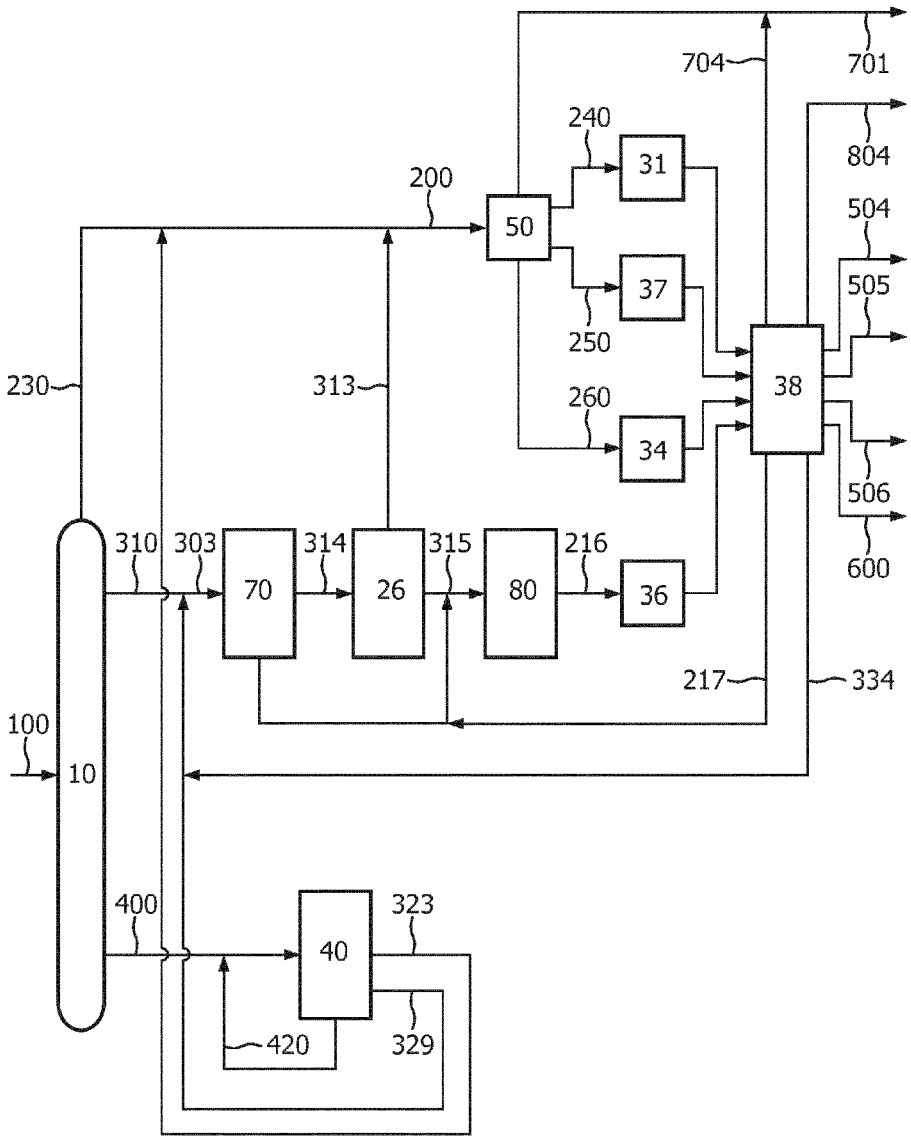
FIG. 5 shows an embodiment of a process installation according to the present invention.

The process installation of the present invention may further comprise a resid upgrading unit (40) comprising an inlet for resid produced by crude distillation (400) and refinery unit-derived heavy-distillate (401) and an outlet for LPG produced by resid upgrading (223) and an outlet for light-distillate and/or middle-distillate produced by resid upgrading (329). The inlet for resid produced by crude distillation (400) and refinery unit-derived heavy-distillate (401) may be combined to form one single inlet into the resid upgrading unit (40) or may form two separate inlets into the resid upgrading unit (40). This aspect of the present invention is presented in FIG. 4 (FIG. 4). The resid upgrading unit (40) may further comprise an outlet for heavy-distillate produced by resid upgrading (420) which may be recycled to the resid upgrading unit (40) to further upgrade said heavy-distillate. This aspect of the present invention is presented in FIG. 5 (FIG. 5).

Preferably, the process installation of the present invention further comprises:

a gas separation unit (50) comprising an inlet for gases produced in the integrated process (200), an outlet for ethane (240), an outlet for propane (250) and an outlet for butane (260);

an ethane cracker (31) comprising an inlet for ethane (240);

a propane cracker (37) comprising an inlet for propane (250);

a butane cracker (34) comprising an inlet for butane (260); and a liquid cracker (36) comprising an inlet for C4+ alkanes (216). This aspect of the present invention is presented in FIG. 5 (FIG. 5).

The gas separation unit (50) may further comprise an outlet for methane (701).

Preferably, the cracked product produced by the crackers is subjected to a separation unit (38) in which the various components comprised in the cracked product are separated. Accordingly, the separation unit (38) may have one or more outlets selected from the group consisting of: an outlet for methane (704), an outlet for hydrogen (804), an outlet for ethylene (504), an outlet for propylene (505), an outlet for butylenes (506) and an outlet for BTX (600). In addition thereto, the separation unit (38) may have an outlet for C4-C8 alkanes (217) which may be recycled to the reverse isomerization unit (80). Furthermore, the separation unit (38) may have an outlet for cracked distillate and/or carbon black oil (334) which may be recycled to the feed to the dearomatization unit (303).

The present invention further provides the use of the process installation according to the present invention for converting crude oil into petrochemical products comprising olefins and BTX.

A further preferred feature of the present invention is that all non-desired products, such as non-high-value petrochemicals may be recycled to the appropriate unit to convert such a non-desired product to either a desired product (e.g. a high-value petrochemical) or to a product that is a suitable as feed to a different unit.

In the process and the process installation of the present invention, all methane produced is collected and preferably subjected to a separation process to provide fuel gas. Said fuel gas is preferably used to provide the process heat in the form of hot flue gases produced by burning the fuel gas or by forming steam. Alternatively, the methane can be subjected to steam reforming to produce hydrogen.

The different units operated in the process or the process installation of the present invention are furthermore integrated by feeding the hydrogen produced in certain processes, such as in olefins synthesis, as a feed stream to the processes that need hydrogen as a feed, such as in hydrocracking. In case the process and the process installation is a net consumer of hydrogen (i.e. during start-up of the process or the process installation or because all hydrogen consuming processes consume more hydrogen than produced by all hydrogen producing processes), reforming of additional methane or fuel gas than the fuel gas produced by the process or the process installation of the present invention may be required.

The following numerical references are used in FIGS. 1-5:

10 crude distillation unit
26 ring opening unit
30 unit for olefins synthesis
31 ethane cracker
34 butane cracker
35 gas cracker
36 liquid cracker
37 propane cracker
38 separation unit
40 resid upgrading unit, preferably a resid hydrocracker
50 gas separation unit
70 dearomatization unit
80 reverse isomerization unit
100 crude oil
200 LPG produced in the integrated process
214 alkanes produced by ring opening unit
215 alkanes
216 n-alkanes
217 C4-C8 alkanes
220 light gases and refinery unit-derived LPG produced in the integrated process
222 LPG produced by ring opening
223 LPG produced by resid upgrading
230 gases fraction
240 ethane
250 propane
260 butanes
303 hydrocarbon feed to dearomatization
310 one or more of naphtha, kerosene and gasoil
313 alkanes enriched stream produced by dearomatization
314 aromatics and naphthenes enriched stream produced by dearomatization
315 C4+ alkanes produced by ring opening
320 refinery unit-derived light-distillate and/or refinery unit-derived middle-distillate produced the integrated petrochemical process installation
329 for light-distillate and/or middle-distillate produced by resid upgrading
334 cracked distillate and/or carbon black oil
400 resid
401 refinery unit-derived heavy-distillate
420 heavy-distillate produced by resid upgrading

500 olefins
501 olefins produced by gas cracker
502 olefins produced by liquid cracker
504 ethylene
505 propylene
506 butylenes
600 BTX
701 methane produced by gas separation
704 methane
804 hydrogen Although the invention has been described in detail for purposes of illustration, it is understood that such detail is solely for that purpose and variations can be made therein by those skilled in the art without departing from the spirit and scope of the invention as defined in the claims.

It is further noted that the invention relates to all possible combinations of features described herein, preferred in particular are those combinations of features that are present in the claims.

It is noted that the term "comprising" does not exclude the presence of other elements. However, it is also to be understood that a description on a product comprising certain components also discloses a product consisting of these components. Similarly, it is also to be understood that a description on a process comprising certain steps also discloses a process consisting of these steps.

The present invention will now be more fully described by the following non-limiting Examples.

COMPARATIVE EXAMPLE 1

The experimental data as provided herein were obtained by flowsheet modelling in Aspen Plus. The steam cracking kinetics were taken into account rigorously (software for steam cracker product slate calculations). The following steam cracker furnace conditions were applied: ethane and propane furnaces: coil outlet temperature (COT)=845° C. and steam-to-oil-ratio=0.37, C4-furnaces and liquid furnaces: COT=820° C. and Steam-to-oil-ratio=0.37. The dearomatization unit was modeled as a splitter into 2 streams, one stream containing all the aromatic and naphthenic components and the other stream containing all the normal- and iso-paraffinic components.

For the ring opening a reaction scheme has been used in which all aromatic, naphthenic and paraffinic compounds were converted into LPG.

A reversed isomerisation unit was modeled by a reaction scheme in which all iso-paraffinic components were converted into their normal-paraffinic counter component.

The resid hydrocracker unit was modeled based on data from literature.

In Comparative Example 1, Arabian light crude oil is distilled in an atmospheric distillation unit. All fractions except the resid being steam cracked. The fractions sent to the steam cracker comprise LPG, naphtha, kerosene and gasoil fractions. The cut point for the resid is 350° C. The total fraction of the crude being sent to the steam cracker amounts to 52 wt % of the crude. In the steam cracker the above mentioned crude fractions being cracked in the furnaces. The results are provided in table 1 as provided herein below.

The products that are derived from the crude oil are divided into petrochemicals (olefins and BTXE, which is an acronym for BTX+ethylbenzene) and other products (hydrogen, methane and heavy fractions comprising C9 resin feed, cracked distillate, carbon black oil and resid). The total amount sums up to 100% of the total crude, since the resid is also taken into account. From the product slate of the crude oil the carbon efficiency is determined as:

(Total Carbon Weight in petrochemicals)/(Total Carbon Weight in Crude).

For the Comparative Example the ethylene yield is 15 wt-% of the total crude.

EXAMPLE 1

Example 1 is identical to the Comparative Example except for the following:

The naphtha, kerosene and gas oil fractions (cut point 350° C.) of the crude distillation are redistributed in a dearomatization unit into 2 streams, one stream containing all aromatic and naphthenic components, one containing all iso- and normal-alkanes. The stream of aromatic and naphthenic components is submitted to ring opening that is operated under process conditions to open all aromatic rings and convert the remaining alkanes and naphthenes into LPG (intermediates). This LPG is separated into ethane-, propane- and butane fractions that are steam cracked. The alkanes stream from the dearomatization unit is also being steam cracked.

Table 1 as provided herein below displays the total product slate from the steam cracker in wt % of the total crude. The table also contains the remaining atmospheric residue fraction.

For Example 1 the ethylene yield is 25 wt-% of the total crude.

EXAMPLE 2

Example 2 is identical to Example 1 except for the following:

First, the resid is upgraded in a resid hydrocracker to produce gases, light-distillate and middle-distillate. The ultimate conversion in the resid hydrocracker is close to completion (the pitch of the resid hydrocracker is 2 wt % of the crude). The gases produced by resid hydrocracking are steam cracked.

The light-distillate and middle-distillate produced by resid hydrocracking are redistributed in a dearomatization unit into 2 streams, one stream containing all aromatic and naphthenic components, one containing all iso- and normal-alkanes. The stream of aromatic and naphthenic components is submitted to ring opening that is operated under process conditions to open all aromatic rings and convert the remaining alkanes and naphthenes into LPG (intermediates). This LPG is separated into ethane-, propane- and butane fractions that are steam cracked. The paraffinic stream from the dearomatization unit is also steam cracked.

Furthermore, the heavy part of the cracker effluent (C9 resin feed, cracked distillate and carbon black oil) is recycled to the dearomatization unit.

Table 1 as provided herein below displays the total product slate from the steam cracker in wt-% of the total crude. The product slate also contains the pitch of the hydrocracker (2 wt-% of the crude).

For Example 2 the ethylene yield is 46 wt-% of the total crude.

EXAMPLE 3

Example 3 is identical to Example 2 except for the following:

The paraffinic stream from the dearomatization unit and the C4 fraction from the ring opening unit is submitted to reversed isomerization, before steam cracking. In the reversed isomerization unit all iso-alkanes are converted into normal-alkanes.

Table 1 as provided herein below displays the total product slate from the steam cracker in wt-% of the total crude. The product slate also contains the pitch of the hydrocracker (2 wt-% of the crude).

For example 3 the ethylene yield is 49 wt-% of the total crude.

TABLE 1

| | Comparative Example | Example 1 | Example 2 | Example 3 |
|---|---|---|---|---|
| Petrochemicals (wt-% of crude) | | | | |
| Ethylene | 15% | 25% | 46% | 49% |
| Propylene | 8% | 9% | 18% | 17% |
| Butadiene | 2% | 2% | 4% | 4% |
| 1-butene | 1% | 1% | 1% | 2% |
| Isobutene | 1% | 1% | 1% | 0% |
| Isoprene | 0% | 0% | 0% | 0% |
| Cyclopentadiene | 1% | 1% | 1% | 1% |
| Benzene | 4% | 2% | 4% | 4% |
| Toluene | 2% | 1% | 1% | 1% |
| Xylene | 1% | 0% | 0% | 0% |
| Ethylbenzene | 1% | 0% | 0% | 0% |
| Other components (wt-% of crude) | | | | |
| hydrogen | 1% | 1% | 2% | 2% |
| methane | 7% | 10% | 18% | 17% |
| Heavy components | 56% | 48% | 0% | 0% |
| RHC pitch and FCC coke | 0% | 0% | 2% | 2% |
| Carbon efficiency | 38.0% | 42.4% | 81.6% | 82.4% |

EXAMPLE 4

This Example more specifically describes dearomatization to produce a first stream enriched in aromatic hydrocarbons and naphthenic hydrocarbons and a second stream enriched in alkanes.

The hydrocarbon feed to dearomatization in this example is straight run naphtha having the following composition: 69.16 wt-% paraffins (normal & iso-paraffins), 23.73 wt-% naphthenes and 7.11 wt-% aromatics. The hydrocarbon feed to dearomatization is processed in a solvent extraction unit comprising three main hydrocarbon processing columns: solvent extraction column, stripper column and extract column. In this example the conventional solvent N-methylpyrolidone (NMP) with 2 wt % water is used. NMP, which is selective for the extraction of aromatics, is also selective for dissolving light naphthenic and to a lesser extent light paraffinic species hence the stream exiting the base of the solvent extraction column comprises the solvent together with dissolved aromatic, naphthenic and light paraffinic species. The stream exiting the top of the solvent extraction column (raffinate stream) comprises the relatively insoluble paraffinic species. The stream exiting the base of the solvent extraction column is then subjected, in a distillation column, to evaporative stripping in which species are separated on the basis of their relative volatility in the presence of the solvent. In the presence of a solvent, light paraffinic species have higher relative volatilities than naphthenic species and especially aromatic species with the same number of carbon atoms, hence the majority of light paraffinic species are concentrated in the overhead stream from the evaporative stripping column. This stream may be combined with the raffinate stream from the solvent extraction column or collected as a separate light hydrocarbon stream. Due to their relatively low volatility the majority of the naphthenic and especially aromatic species are retained in the combined solvent and dissolved hydrocarbon stream exiting the base of this column. In the final hydrocarbon processing column of the extraction unit, the solvent is separated from the dissolved hydrocarbon species by distillation. In this step the solvent, which has a relatively high boiling point, is recovered as the base stream from the column whilst the dissolved hydrocarbons, comprising mainly aromatics and naphthenic species, are recovered as the vapour stream exiting the top of the column. This latter stream is termed the extract.

In this Example, the following conditions for the extractor column were used:

Solvent: NMP with 2 wt % water

5:1 Solvent: Feed ratio (mass) in extraction column:

Overhead Pressure: 5.5 BarG

Column Base Pressure: 6.5 BarG

Feed temperature: 50° C.

Solvent Temperature: 60° C.

Overhead Temperature: 60° C.

Base Temperature: 50° C.

The extractor column overhead stream may have the following composition:

| Component types | Wt % | Fraction of component type |
|---|---|---|
| Paraffins (normal & Iso-) | 81% | 68% |
| Naphthenes | 19% | 48% |
| Aromatics | >1% | >1% |

The extractor column bottoms stream may have the following composition: (solvent free):

| Component types | Wt % | Fraction of component type |
|---|---|---|
| Paraffins (normal & Iso-) | 53% | 32% |
| Naphthenes | 30% | 52% |
| Aromatics | 17% | 100% |

Note:
Extractor column base is the feed for the stripper column

In this Example, the following conditions for the stripper column were used:

Overhead Pressure: 1.52 BarG

Column Base Pressure: 1.77 BarG

Overhead Temperature: 94.11° C.

Column Base Temperature: 175° C.

The stripper column overhead stream may have the following composition:

| Component Types | Wt % | Fraction of Component Type |
|---|---|---|
| Paraffins (normal & Iso-) | 91% | 21% |
| Naphthenes | 8% | 6% |
| Aromatics | >1% | <1% |

The stripper column bottom stream may have the following composition (solvent free):

| Component Types | Wt % in Extract | Fraction of Component in Extract |
|---|---|---|
| Paraffins (normal & Iso-) | 29% | 11% |
| Naphthenes | 43% | 47% |
| Aromatics | 28% | >99% |

Extract:

The extract column overhead stream/extract stream may have the following composition (solvent free):

| Component Types | Wt % in Extract | Fraction of Component in Extract |
|---|---|---|
| Paraffins (normal & Iso-) | 29% | 11% |
| Naphthenes | 43% | 47% |
| Aromatics | 28% | >99% |

Note:
Extract column overhead composition is the same as the solvent free composition of the stripper column bottom stream.

Combined raffinate stream (combination of extractor column overhead and stripper column overhead) may have the following composition (solvent free):

| Component Types | Wt % in Extract | Fraction of Component in Extract |
|---|---|---|
| Paraffins (normal & Iso-) | 83% | 89% |
| Naphthenes | 17% | 53% |
| Aromatics | <1% | <1% |

In summary, using NMP+2 wt % water as a solvent in solvent extraction unit comprising three main hydrocarbon processing column (solvent extraction column, stripper column and extract column), it is possible to separate hydrocarbon stream (in this case straight run naphtha) into a raffinate stream which, compared with the feed, is rich in paraffins, comparatively lean in naphthenes and essentially free of aromatics and a separate extract stream which is lean in paraffins (compared with the feed) and comparatively rich in naphthenes and aromatics.

The invention claimed is:

1. A process, the process comprising the steps of:

(a) subjecting a hydrocarbon feed to dearomatization to produce a first stream comprising aromatic hydrocarbons and naphthenic hydrocarbons and a second stream comprising alkanes;

(b) subjecting the stream comprising aromatic hydrocarbons and naphthenic hydrocarbons to ring opening to produce alkanes from the ring-opened aromatic hydrocarbons and naphthenic hydrocarbons; and (c) subjecting only the alkanes from step (b) to gas separation, and (d) subjecting individual gases produced in the gas separation to olefins synthesis, wherein the olefins synthesis is selected from the group consisting of non-catalytic pyrolysis of ethane, non-catalytic pyrolysis of propane, catalytic pyrolysis of butane, catalytic dehydrogenation of propane and catalytic dehydrogenation of butane, wherein said hydrocarbon feed comprises:

one or more of naphtha, kerosene and gasoil produced by crude oil distillation in the process; and at least one member selected from the group consisting of refinery unit-derived light-distillate and refinery unit-derived middle-distillate produced in the process; and wherein the process is integrated.

2. The process according to claim 1, further comprising subjecting the alkanes produced in at least one of steps (a) or (b) to reverse isomerization to produce n-alkanes which are subjected to the olefins synthesis.

3. The process according to claim 2, which process further comprises:

(a) subjecting crude oil to crude oil distillation to produce one or more of gases fraction, naphtha, kerosene, gasoil and resid; and (b) subjecting resid to resid upgrading to produce LPG and light- and middle-distillate.

4. The process according to claim 3, wherein the resid upgrading is resid hydrocracking.

5. The process according to claim 1, wherein the ring opening produces a first stream comprising LPG and a second stream comprising C4+ alkanes and wherein said stream comprising C4+ alkanes is combined with alkanes produced by dearomatization.

6. The process according to claim 1, wherein said alkanes from at least one of steps (a) or (b) comprise C4+ alkanes, and subjecting the C4+ alkanes to liquid cracking.

7. The process according to claim 1, which process further comprises:

(a) subjecting crude oil to crude oil distillation to produce one or more of gases fraction, naphtha, kerosene, gasoil and resid; and (b) subjecting resid to resid upgrading to produce LPG and light- and middle-distillate.

8. The process according to claim 7, wherein the resid upgrading is resid hydrocracking.

9. A process consisting of the steps of:

(a) subjecting a hydrocarbon feed to dearomatization to produce a first stream comprising aromatic hydrocarbons and naphthenic hydrocarbons and a second stream comprising alkanes;

(b) subjecting the stream comprising aromatic hydrocarbons and naphthenic hydrocarbons to ring opening to produce alkanes from the ring-opened aromatic hydrocarbons and naphthenic hydrocarbons; and (c) subjecting the alkanes from step (b) to gas separation, and (d) subjecting individual gases produced in the gas separation to olefins synthesis, wherein the olefins synthesis is selected from the group consisting of non-catalytic pyrolysis of ethane, propane, and butane, catalytic dehydrogenation of propane and catalytic dehydrogenation of butane, wherein said hydrocarbon feed comprises:

one or more of naphtha, kerosene and gasoil produced by crude oil distillation in the process; and refinery unit-derived light-distillate and/or refinery unit-derived middle-distillate produced in the process; and wherein process is integrated.

* * * * *